US009265361B1

(12) United States Patent
Streich et al.

(10) Patent No.: US 9,265,361 B1
(45) Date of Patent: Feb. 23, 2016

(54) MERCHANDISE HANGER, ASSOCIATED ASSEMBLIES, AND METHODS

(71) Applicant: TARGET BRANDS, INC., Minneapolis, MN (US)

(72) Inventors: Jacob Streich, St. Louis Park, MN (US); Jake Strassburger, South Plainfield, NJ (US)

(73) Assignee: TARGET BRANDS, INC., Minneapolis, MN (US)

( * ) Notice: Subject to any disclaimer, the term of this patent is extended or adjusted under 35 U.S.C. 154(b) by 78 days.

(21) Appl. No.: 14/464,387

(22) Filed: Aug. 20, 2014

(51) Int. Cl.

| | |
|---|---|
| ***A47G 1/16*** | (2006.01) |
| ***A47F 5/00*** | (2006.01) |
| ***A47F 7/00*** | (2006.01) |
| ***B65B 61/14*** | (2006.01) |

(52) U.S. Cl.
CPC ..... *A47F 5/0006* (2013.01); *A47F 7/0042* (2013.01); *B65B 61/14* (2013.01)

(58) Field of Classification Search
CPC combination set(s) only.
See application file for complete search history.

(56) References Cited

U.S. PATENT DOCUMENTS

| | | | | |
|---|---|---|---|---|
| 468,639 | A | 2/1892 | Bryant | |
| 746,617 | A | 12/1903 | Wenzell | |
| 1,914,951 | A | 6/1933 | Kiessling | |
| 2,317,204 | A | 4/1943 | Lowenthal | |
| 2,336,537 | A * | 12/1943 | Fowler | A47F 7/163 211/45 |
| 3,123,331 | A | 3/1964 | Field et al. | |
| 3,179,363 | A | 4/1965 | Sheiman | |
| 3,289,985 | A | 12/1966 | Sheiman | |
| 3,435,999 | A | 4/1969 | Mantell | |
| 3,501,124 | A | 3/1970 | Goss | |
| 3,512,621 | A | 5/1970 | Teetor | |
| 3,710,996 | A | 1/1973 | Smilow et al. | |
| 3,755,859 | A | 9/1973 | Solari | |
| 3,851,790 | A | 12/1974 | Kasper | |
| 4,542,824 | A | 9/1985 | Allen | |
| 4,632,242 | A | 12/1986 | Choi et al. | |
| 4,832,301 | A | 5/1989 | Hiramoto et al. | |
| 4,889,265 | A | 12/1989 | Morgan | |
| 4,932,571 | A | 6/1990 | Blanchard | |
| 5,064,061 | A | 11/1991 | Moxley | |
| 5,222,638 | A | 6/1993 | Kolton et al. | |
| 5,291,976 | A | 3/1994 | Ku | |
| 5,328,137 | A | 7/1994 | Miller et al. | |

(Continued)

OTHER PUBLICATIONS

Office Action from Canadian Patent Application No. 2,877,713, mailed May 7, 2015 (5 pages).

*Primary Examiner* — Monica Millner
(74) *Attorney, Agent, or Firm* — Griffiths & Seaton PLLC; Joann M. Seaton

(57) ABSTRACT

A merchandise hanger includes a coupling member and a support interface member. The coupling member includes a cross component, a latch component, and a flexible strap. The cross component includes an elongated panel and a track section, wherein the elongated panel defines latch-receiving apertures. The latch component includes an elongated plate and opposing hooks extending from the elongated plate. The flexible strap extends from the cross component to the latch component. The coupling member folds about the flexible strap to move the opposing hooks of the latch component into alignment with the latch-receiving apertures of the cross component. The opposing hooks are configured to move through the latch-receiving apertures to couple the cross component to the latch component. The support interface member is slidably received within the track section of the coupling member and is configured to slidably transition between a storage position and a hanging position.

20 Claims, 17 Drawing Sheets

(56) References Cited

U.S. PATENT DOCUMENTS

| | | | | |
|---|---|---|---|---|
| 5,429,284 | A | 7/1995 | Kolton et al. | |
| 5,509,528 | A | 4/1996 | Weisburn | |
| 5,520,311 | A | 5/1996 | Lam | |
| 5,556,014 | A | 9/1996 | Kolton et al. | |
| 5,582,387 | A | 12/1996 | Kolton et al. | |
| 5,593,009 | A | 1/1997 | King | |
| 5,615,810 | A | 4/1997 | Kolton et al. | |
| 5,620,118 | A | 4/1997 | Kolton et al. | |
| 5,799,843 | A | 9/1998 | Hsu | |
| 5,906,349 | A | 5/1999 | Roy | |
| 5,927,451 | A | 7/1999 | Tsai | |
| 5,957,344 | A | 9/1999 | Kolton | |
| RE36,412 | E | 11/1999 | Jones | |
| 5,988,381 | A | 11/1999 | Ling | |
| 6,012,594 | A * | 1/2000 | Heinz | A47B 97/02 211/106 |
| 6,094,848 | A | 8/2000 | Heath et al. | |
| 6,102,461 | A | 8/2000 | Rooney et al. | |
| 6,206,253 | B1 | 3/2001 | Kolton et al. | |
| 6,267,254 | B1 | 7/2001 | Chen | |
| 6,446,932 | B1 | 9/2002 | Butterfield et al. | |
| 6,497,347 | B1 | 12/2002 | Feibelman et al. | |
| 6,609,693 | B2 | 8/2003 | Hui | |
| 6,766,997 | B2 | 7/2004 | Stewart, III | |
| 6,769,541 | B1 | 8/2004 | Carriere | |
| D506,125 | S | 6/2005 | Munson et al. | |
| D506,919 | S | 7/2005 | Munson et al. | |
| 6,923,413 | B2 | 8/2005 | Dozier | |
| 7,040,582 | B2 | 5/2006 | Rosler | |
| 7,128,222 | B2 | 10/2006 | Doucette | |
| D531,488 | S | 11/2006 | Munson et al. | |
| D542,631 | S | 5/2007 | Munson et al. | |
| D551,542 | S | 9/2007 | Gallien et al. | |
| 7,318,572 | B2 | 1/2008 | Dozier | |
| 7,624,959 | B2 | 12/2009 | Dozier et al. | |
| 7,753,241 | B2 * | 7/2010 | Masanek, Jr. | A47F 5/0006 211/113 |
| 8,070,121 | B2 | 12/2011 | Dozier et al. | |
| 8,136,209 | B1 | 3/2012 | Willison | |
| D657,577 | S | 4/2012 | Coote | |
| 8,308,034 | B2 | 11/2012 | Shibata et al. | |
| 8,308,119 | B2 | 11/2012 | Foltz et al. | |
| 8,418,858 | B2 | 4/2013 | Foltz et al. | |
| 8,573,411 | B2 | 11/2013 | Foltz et al. | |
| 8,579,245 | B2 | 11/2013 | Foltz et al. | |
| 2003/0106980 | A1 | 6/2003 | Hui | |
| 2006/0054771 | A1 * | 3/2006 | Lie | A47G 1/205 248/489 |
| 2011/0068067 | A1 * | 3/2011 | Foltz | A47F 5/0006 211/59.2 |
| 2011/0168597 | A1 * | 7/2011 | Titros | B65D 73/0064 206/495 |
| 2011/0253861 | A1 * | 10/2011 | Kressin | A47G 1/1653 248/224.61 |
| 2012/0025680 | A1 | 2/2012 | Lu | |

* cited by examiner

MERCHANDISE HANGER, ASSOCIATED ASSEMBLIES, AND METHODS

BACKGROUND OF THE INVENTION

Pictures, picture frames (oftentimes including pictures), artwork, and similar products are generally packaged and transported in cardboard packaging, which allows viewing of the products while at the same time protecting the edges and corners of the products from damage. Whether or not such products are wrapped in cardboard packing, the size and weight of such products has created difficulties in effectively displaying these products in a retail setting. The products are often stacked on the floor or placed on a shelf for viewing by potential consumers.

In other instances, the products are hung from retail supports to be viewed by potential consumers. When the products are hung, hangers or other mechanisms facilitating such hanging often protrude from the edges of the products. These protrusions create awkwardly sized products to pack and ship, which, in turn, increases expenses generally associated with packing and shipping the associated products.

SUMMARY

One aspect of the present invention relates to a merchandise hanger including a coupling member and a support interface member. The coupling member includes a cross component, a latch component, and a flexible strap. The cross component includes an elongated panel and a track section, wherein the elongated panel defines latch-receiving apertures extending through the elongated panel. The latch component including an elongated plate and opposing hooks extending rearwardly from the elongated plate. The flexible strap extends from the cross component to the latch component to couple the cross component to the latch component. The coupling member is configured to be folded about the flexible strap to move the opposing hooks of the latch component into alignment with the latch-receiving apertures of the cross component. The opposing hooks are configured to move through the latch-receiving apertures to couple the cross component to the latch component. The support interface member is slidably received within the track section of the coupling member and is configured to hang from a support structure in a hanging position and being configured to slidably transition between a storage position and the hanging position. Other related products, retail display assemblies, and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Merchandise hangers provide effective mechanisms for hanging products for retail sale from retail display support structures. In one embodiment, each merchandise hanger is configured to transition from a shipping position, in which the merchandise hanger is maintained substantially entirely within a footprint of a corresponding product or item of merchandise, and a display or hanging position, in which the merchandise hanger protrudes from a perimeter of the corresponding product to facilitate hanging the product from the support structure incorporated into the corresponding retail display. The transition of the merchandise hanger between shipping and hanging positions allows the products with merchandise hangers to be provided in compact sizes and shapes for shipping and transportation while still providing an effective interface to support the products in a retail display. In one example, the merchandise hanger is formed or molded from a single material, such as plastic, etc. in a manner providing a cost effective, easy to use, and aesthetically pleasing hanger for the corresponding product.

Figure 1:
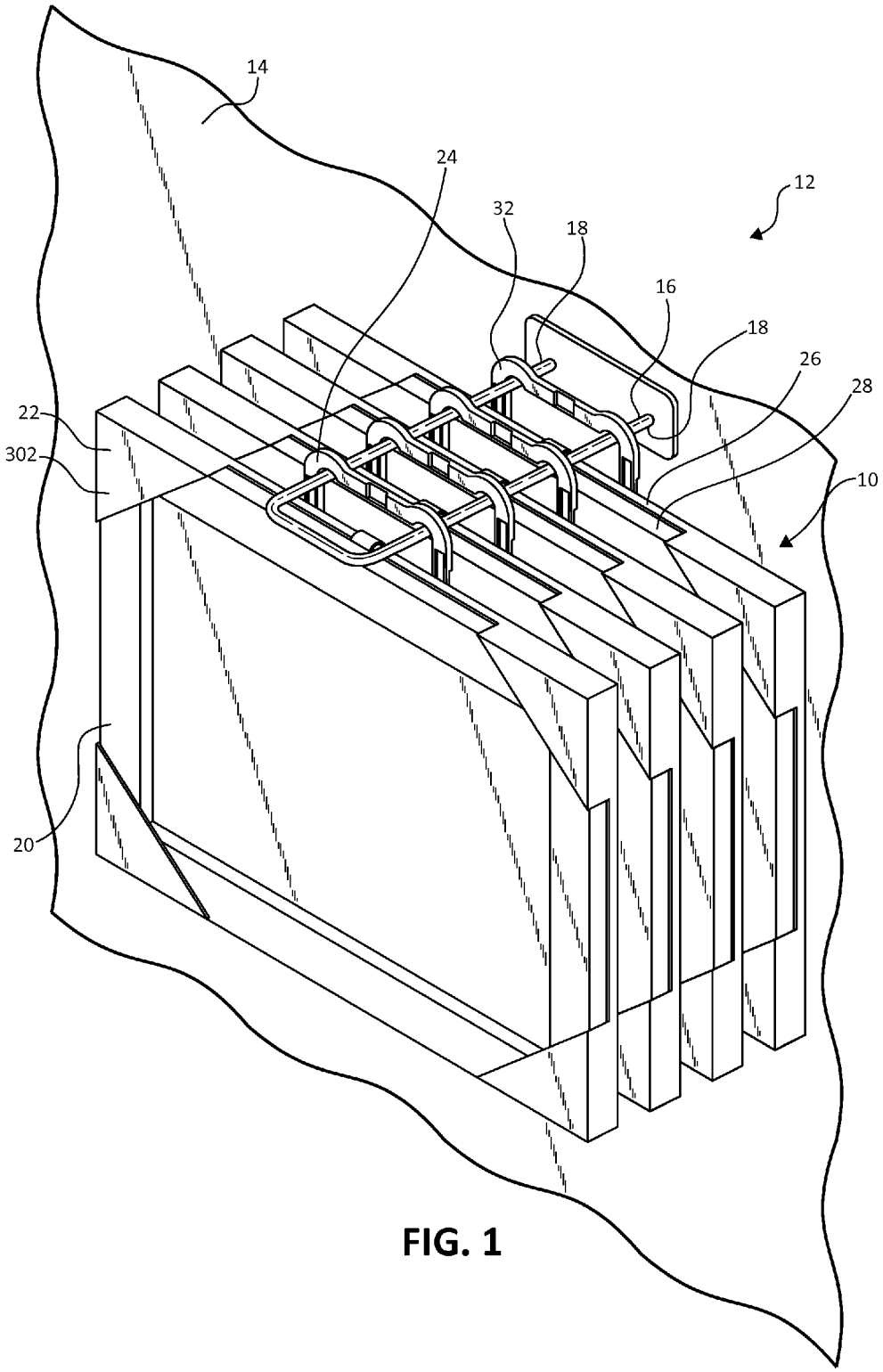
FIG. 1 is a front, perspective view illustration of a plurality of packaged product assemblies hung in a merchandise display, according to one embodiment of the present invention.

Turning to the figures, FIG. 1 illustrates a number of packaged product assemblies 10 included in a retail display 12, according to one exemplary use of one embodiment of the present invention. Retail display 12 includes a display wall 14 and a support arm or other support structure 16 cantilevered forwardly from the display wall 14 for selectively supporting packaged product assemblies 10 hanging therefrom, according to one embodiment. In one example, support structure 16 includes two substantially parallel rods 18 each extending forwardly from display wall 14 such that packaged product assemblies 10 can be hung therefrom.

Figure 2:
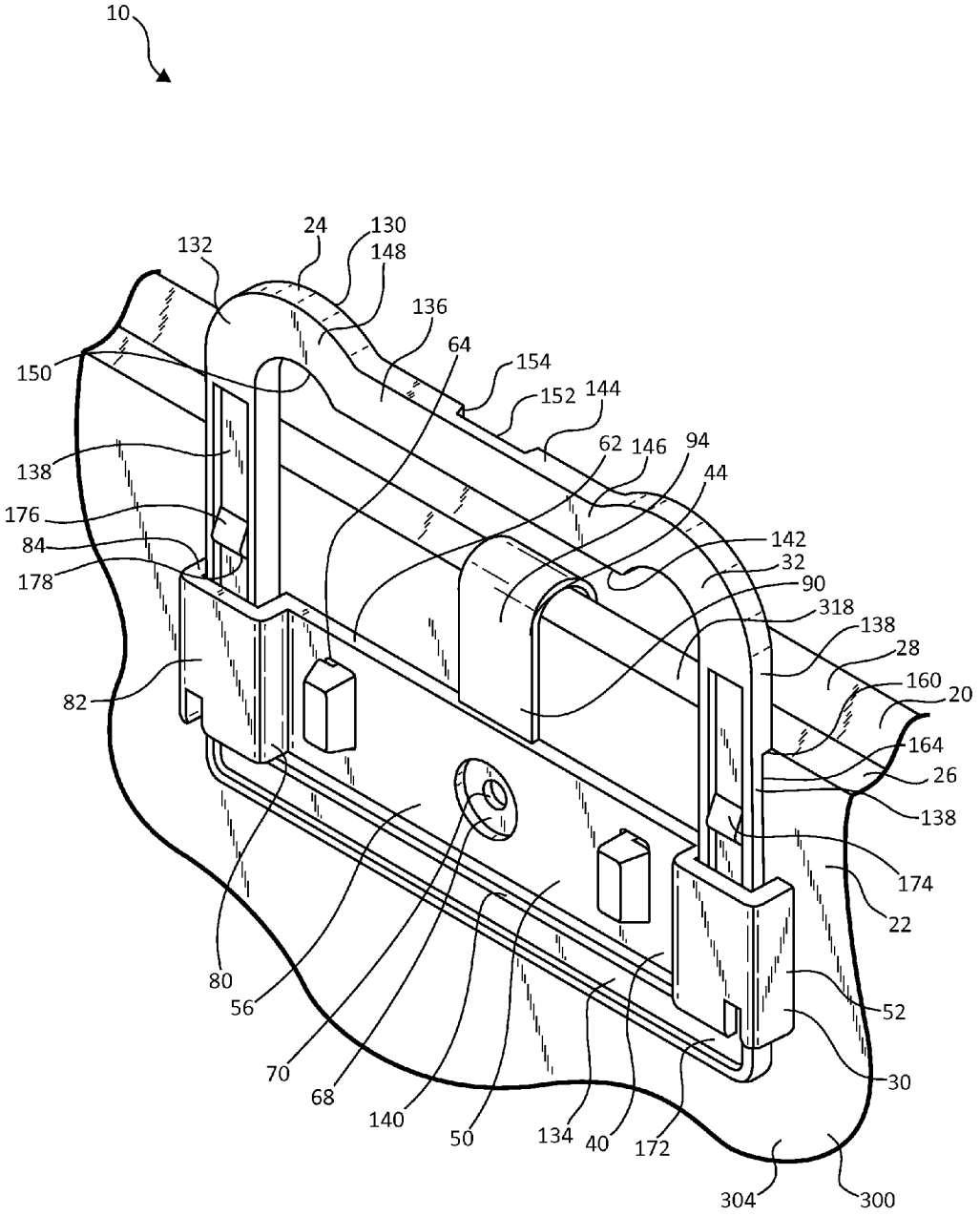
FIG. 2 is a rear, perspective view illustration of one of the plurality of packaged product assemblies of FIG. 1 with the hanger in a hanging position, according to one embodiment of the present invention.
Figure 3:
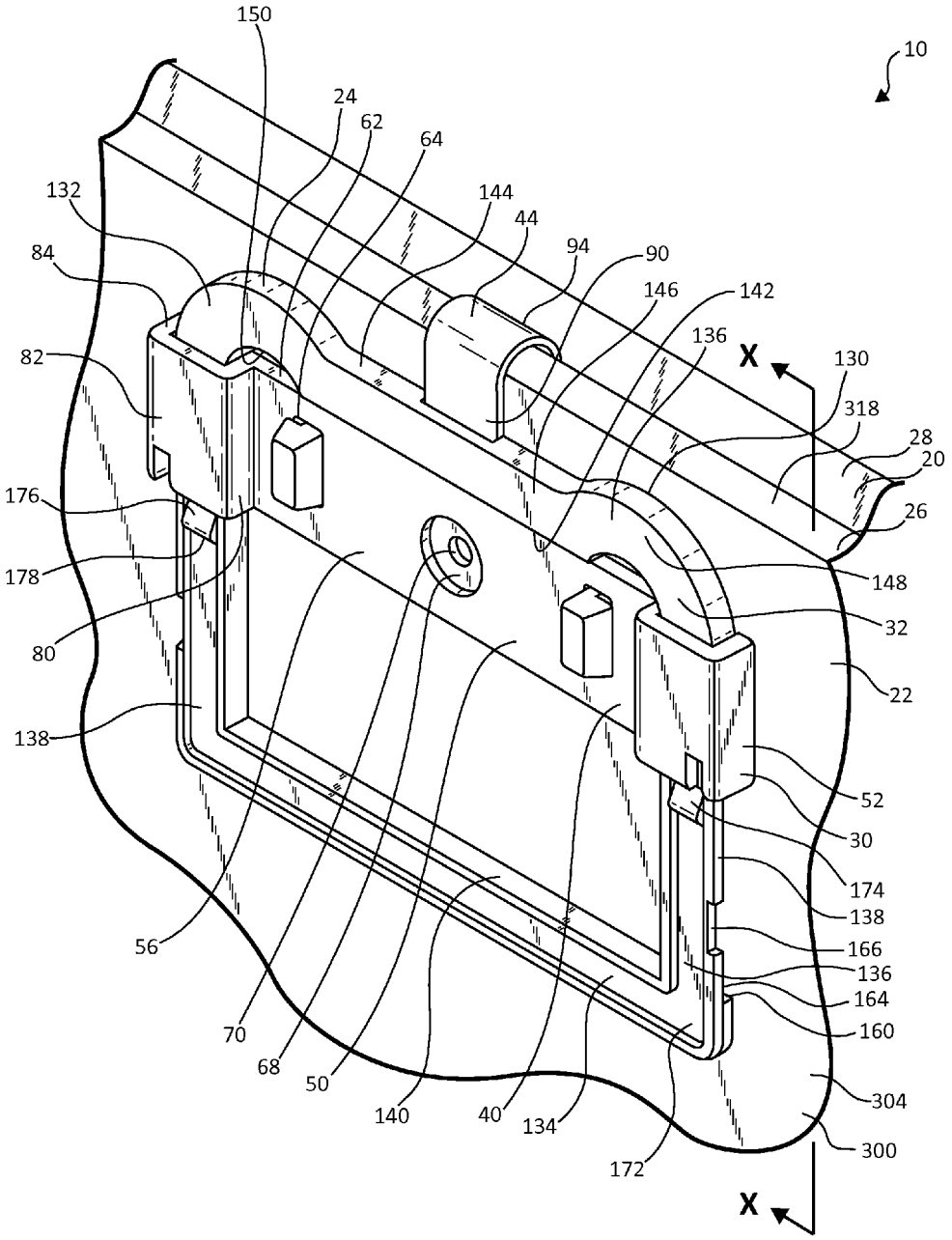
FIG. 3 is a rear, perspective view illustration of the packaged product assembly of FIG. 2 with the hanger in a shipping position, according to one embodiment of the present invention.

Each packaged product assembly 10 includes a product 20, a package 22, and a hanger 24. Product 20 is any suitable product, for example, being offered for retail sale, and in one embodiment, is a substantially two-dimensional item with relatively small thickness such as a frame, framed object or art, wall hanging, message board, book, shadow box, office product, etc. Package 22 at least partially wraps around product 20 to maintain product 20 therein and/or to protect edges and/or corners thereof. Additionally referring to FIGS. 2 and 3, hanger 24 is placed near a top edge of package 22 and is configured to transition from a storage position (see, e.g., FIGS. 3 and 18), for example, largely positioned with an overall footprint of package 22, to an in-use or hanging position (see, e.g., FIGS. 1 and 2) extending upwardly away from a topmost surface 26 of package 22 and/or a topmost surface 28 of product 20 to selectively receive two parallel rods 18, according to one embodiment.

Figure 4:
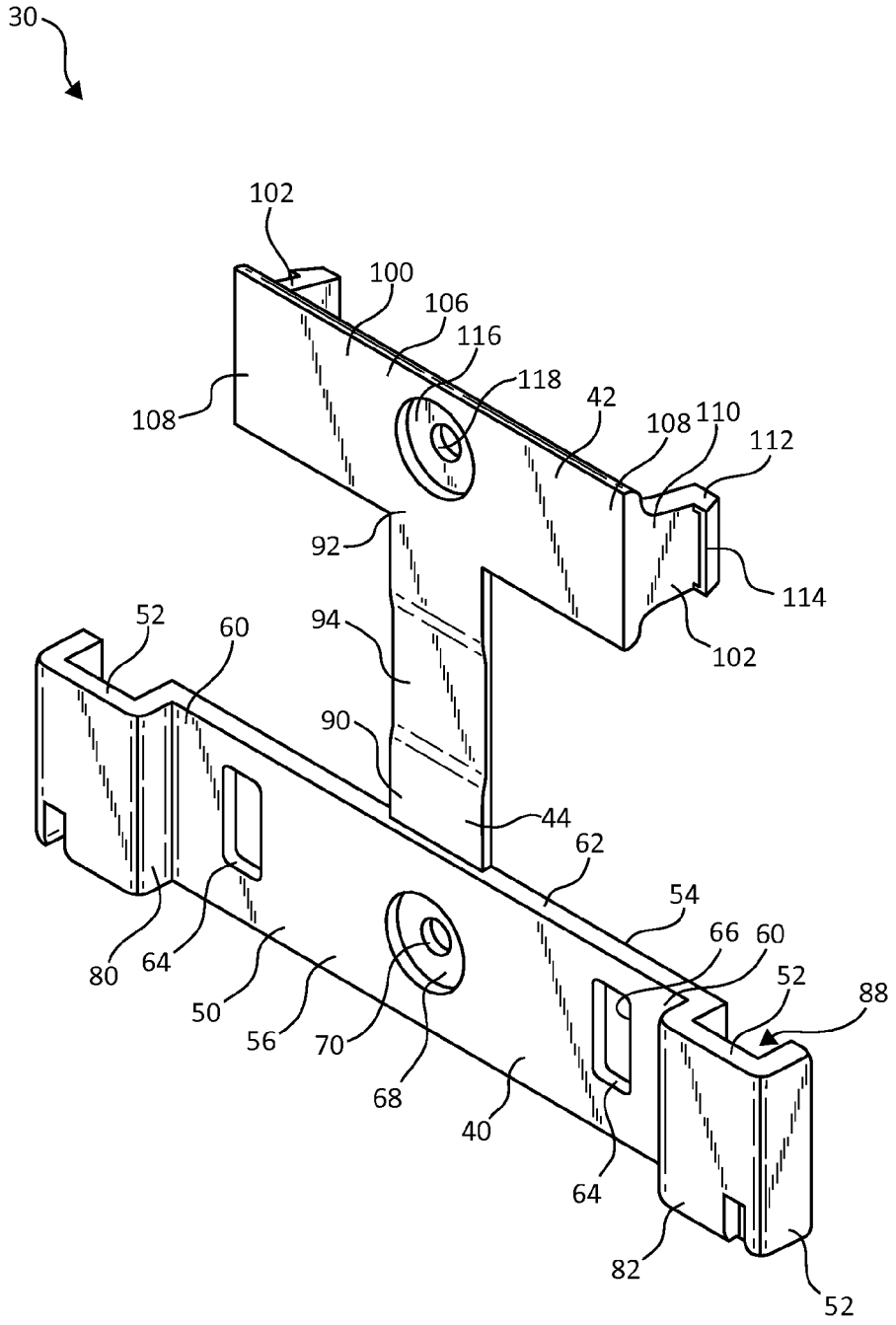
FIG. 4 is a rear, perspective view illustration of a coupling member of the hanger of FIG. 2, according to one embodiment of the present invention.
Figure 5:
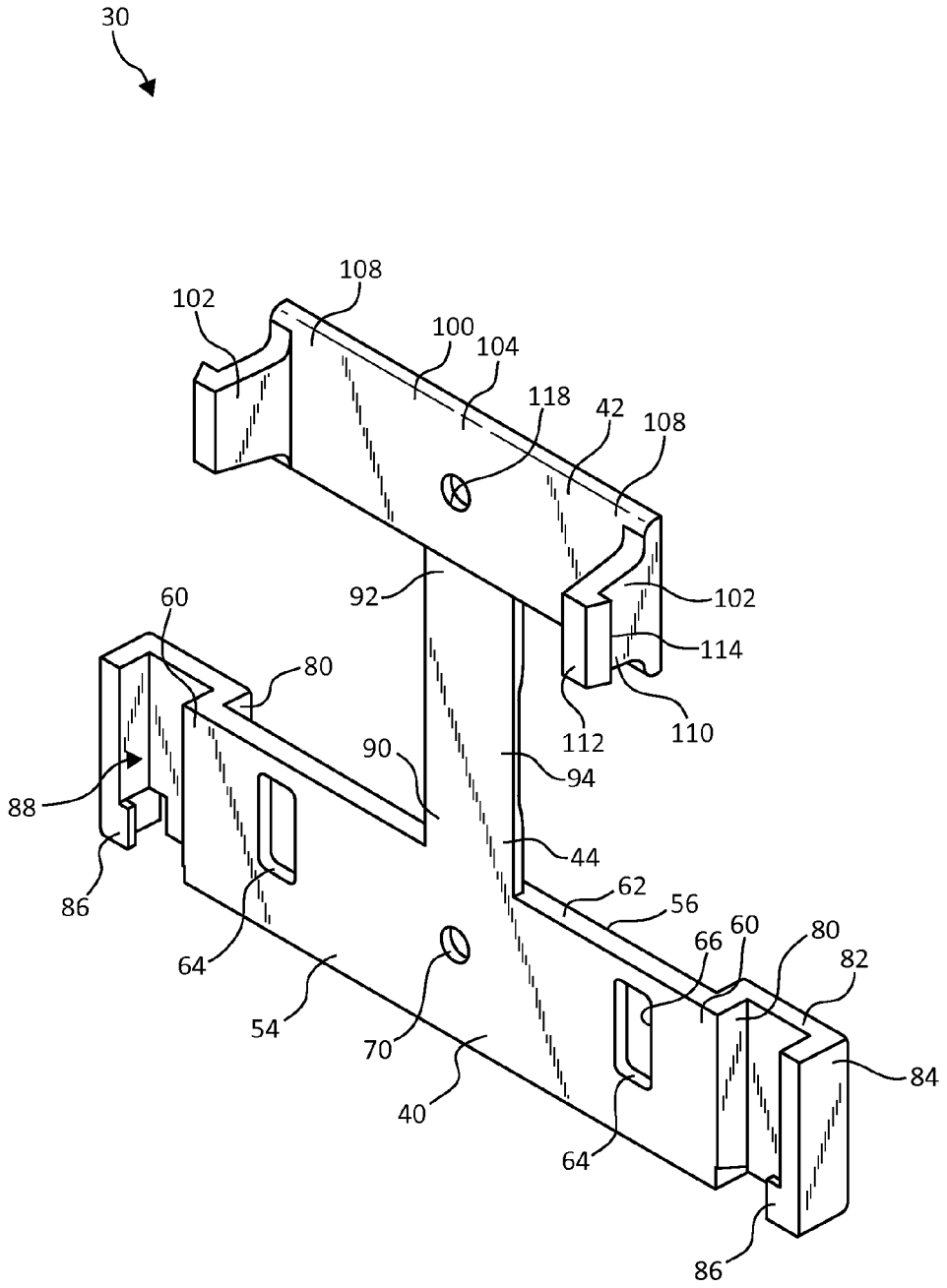
FIG. 5 is a front, perspective view illustration of the coupling member of FIG. 4, according to one embodiment of the present invention.
Figure 6:
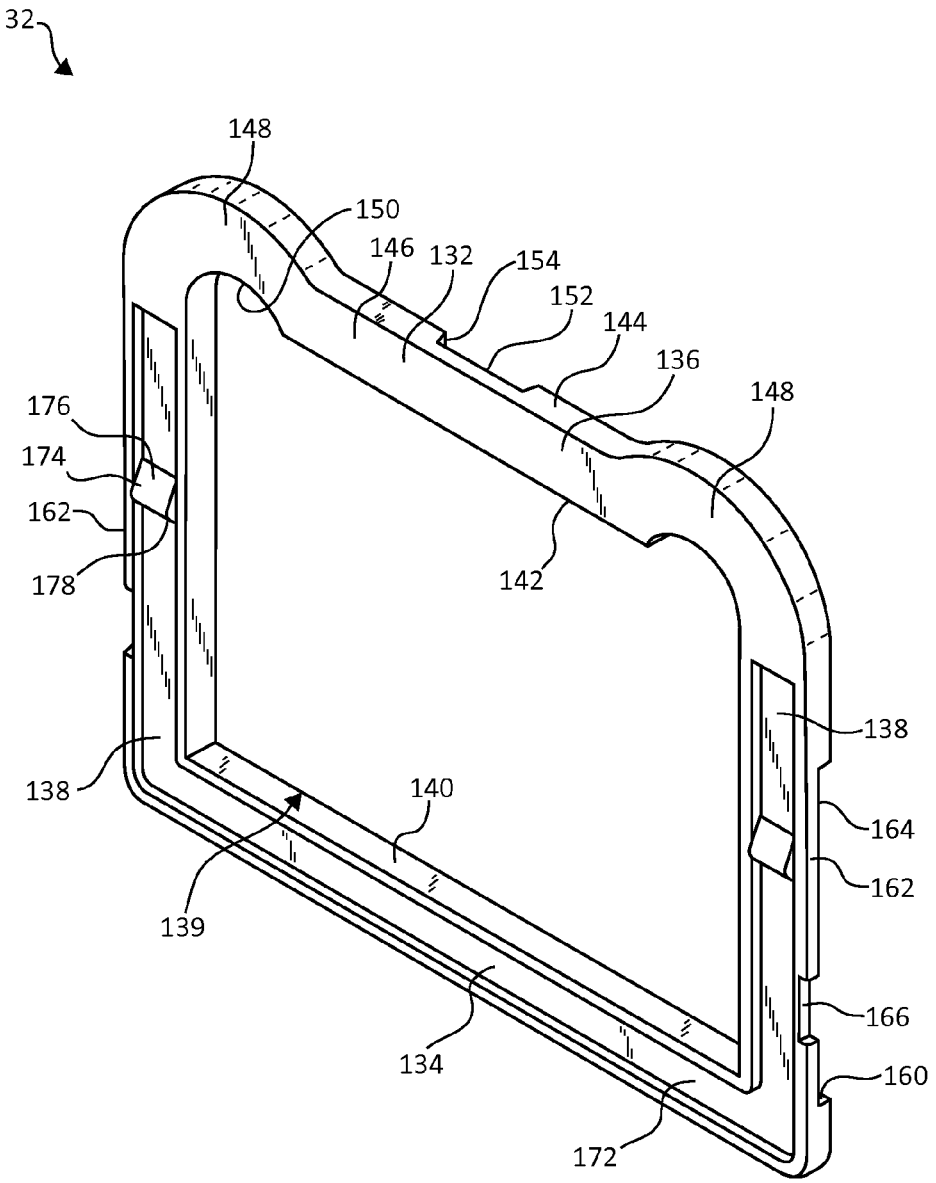
FIG. 6 is a rear, perspective view illustration of a support interface member of the hanger of FIG. 2, according to one embodiment of the present invention.
Figure 7:
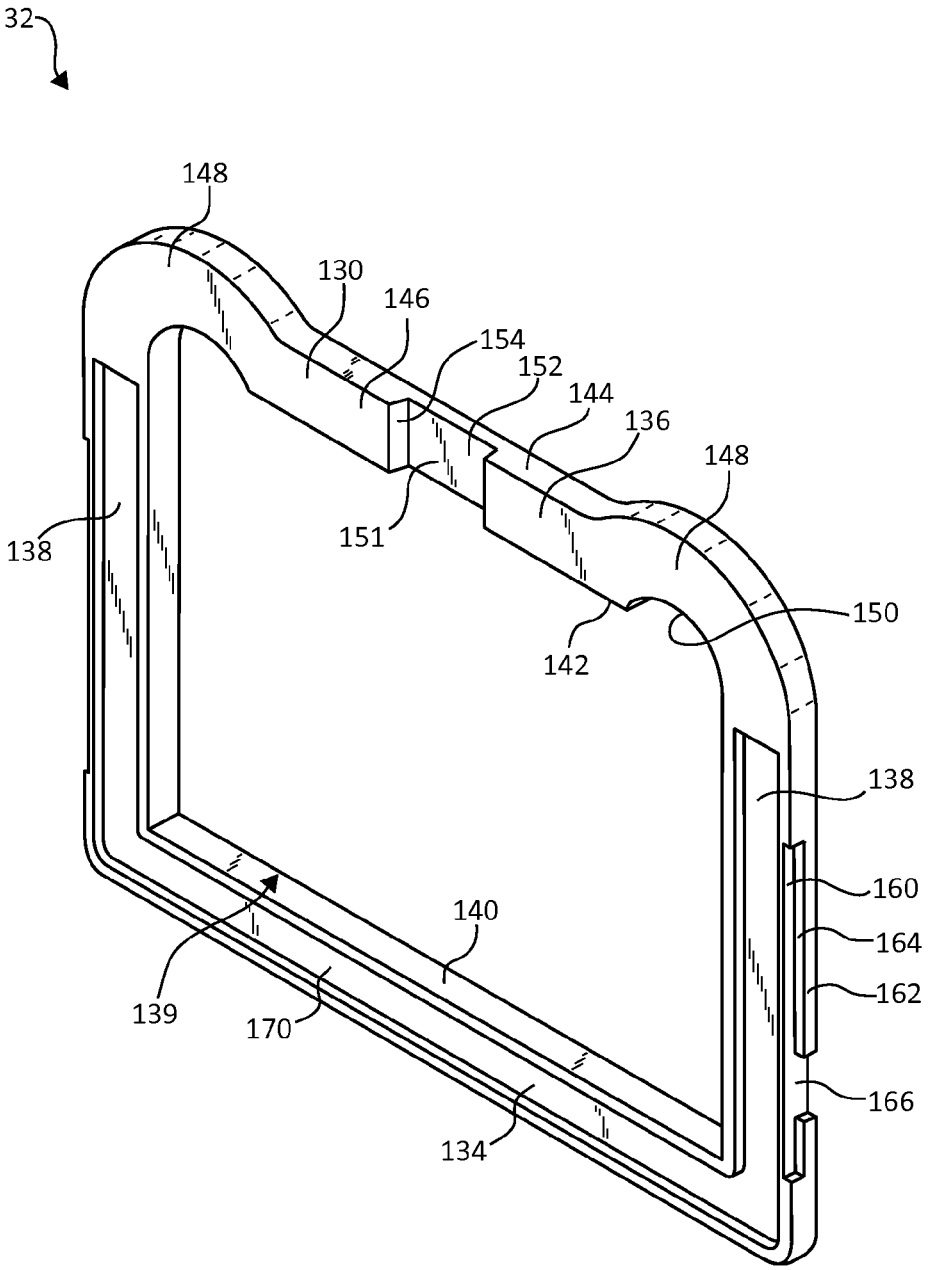
FIG. 7 is a front, perspective view illustration of the support interface member of FIG. 6, according to one embodiment of the present invention.

In one embodiment, hanger 24 more specifically includes a first or coupling member 30 and a second or support interface member 32. Coupling member 30 is configured to be secured to package 22 in a substantially static manner. Support interface member 32 is at least partially received by coupling member 30 and is configured to linearly translate up and down, thereby, transitioning hanger 24 between the storage position and the hanging position. Additionally referring to FIGS. 4 and 5, coupling member 30 includes a rear cross component 40, a latch component 42, and strap 44, according to one example. Rear cross component 40 includes an elongated panel 50 and at least one track section 52, for example, two track sections 52 each on opposite lateral ends 60 of elongated panel 50.

Elongated panel 50 is a substantially planar portion of coupling member 30 and defines a first or front surface 54 and a second or rear surface 56 opposite front surface 54. Elongated panel 50 further defines a first longitudinal or top edge 62, which, in one example, is substantially linear, for instance, where elongated panel 50 is substantially rectangular in shape. Elongated panel 50 is largely continuous other than defining a latch-receiving aperture(s) 64 and, in one example, a recess 68 having an aperture 70 formed therein.

Each latch-receiving aperture 64 and aperture 70 extends entirely through a thickness of elongated panel 50, that is from front surface 54 to rear surface 56, while recess 68 only interrupts rear surface 56 of elongated panel 50. Each latch-receiving aperture 64 defines an outside edge nearest the closer of lateral ends 60, which, in one example, is substantially linear. In one example, elongated panel 50 defines two latch-receiving apertures 64 each positioned near a different one of lateral ends 60 of elongated panel 50. Aperture 70 is positioned between the two-latch receiving apertures 64 and, in one embodiment, is configured to receive a fastener (not shown) to add to the securement of hanger 24 to package 22. Recess 68 extends around aperture 70 with a larger overall diameter than recess 68. In one example, aperture 70 and recess 68 are eliminated.

Each track section 52 includes an offset or interior sidewall 80, a rear wall 82, and an exterior sidewall 84. In one example, interior sidewall 80 extends from one of lateral ends 60 of elongated plate 50 rearwardly to intersect with rear wall 82 opposite elongated panel 50. Each rear wall 82 extends from the corresponding interior sidewall 80 longitudinally away from elongated panel 50 to intersect exterior sidewall 84, and exterior sidewall 84 extends forwardly from the corresponding rear wall 82. In one example, exterior sidewall 84 extends forwardly terminating near or in the same plane as a front surface 54 of elongated panel 50. In this manner, track section 52 defines a channel 88 between interior sidewall 80, rear wall 82, and exterior sidewall 80 of each track section 52 and open forwardly and at a top and bottom thereof. In one embodiment, exterior sidewall 84 additionally includes a cam or tab 86 (e.g., FIG. 5) extending from a front edge of exterior sidewall 84 opposite rear wall 82 inwardly toward, but not to, interior sidewall 80. In one example, tab 86 has a height less than, for example, less than 50% of a height of track section 52. Each of elongated panel 50 and track sections 52 have a substantially identical height with top and bottom edges of elongated panel being aligned with top and bottom edges of track sections 52, in one embodiment.

Strap 44 extends from top edge 62 of elongated panel 50 of rear cross component 40 to latch component 42. More specifically, in one embodiment, strap 44 defines a first end 90, which is coupled to elongated panel 50, and a second end 92, which is coupled to latch component 42. Strap 44 is an elongated, for example, substantially rectangular and flexible member, that is readily bendable over itself and has a width less than each of rear cross component 40 and latch component 42. In one embodiment, strap 44 extends substantially perpendicularly to the extension of elongated panel 50. Strap 44 includes an intermediate or thinned section 94 spaced between and from each of first end 90 and second end 92 that has a smaller material thickness than other portions of strap 44, in one embodiment. Thinned section 94 facilitates bending of strap 44 especially bending of strap 44 over itself.

In one embodiment, latch component 42 is coupled to second end 92 of strap 44 and includes, an elongated plate 100 and opposing latches or hooks 102. Elongated plate 100 is substantially planar defining a first surface 104, a second surface 106 opposite and, in one example, substantially parallel to first surface 104 and extends between two opposing lateral ends 108. Elongated plate 100 extends substantially parallel to elongated panel 50 of rear cross component 40 and/or substantially perpendicularly to strap 44, in one embodiment. In one example, at least second surface 106 of elongated plate 100 is substantially coplanar with at least a portion of strap 44 adjacent elongated plate 100.

Each opposing hook 102 includes an offset wall 110 and a return flange 112. Offset wall 110 extends from a different one of lateral ends 108 away from second surface 106 of elongated plate 100. Return flange 112 extends outwardly, that is away from the other one of opposing hooks 102 from and end of offset wall 110 opposite elongated plate 100. In one embodiment, return flange 112 defines a free edge 114 opposite offset wall 110 and facing toward second surface 106. In one example, each of opposing hooks 102 is sized to fit within a corresponding one of latch-receiving apertures 64 as will be further described below.

In one example, latch component 42 additionally defines a center or otherwise positioned recess 116 and an aperture 118 centered within recess 116. Recess 116 and aperture 118 are positioned between, for example, centered between, opposing hooks 102. Aperture 118 extends from first surface 104 to second surface 106, and recess 116 extends from second surface 106 toward, but not all the way to, first surface 104. In one embodiment, recess 116 is sized and shaped substantially identically to recess 68 and/or aperture 118 is sized and shaped substantially identically to aperture 70. Aperture 118 is configured to receive a fastener (not shown) to add to the securement of hanger 24 to package 22. Recess 116, more particularly, extends around aperture 118 with a larger overall diameter than recess 116. In one example, aperture 118 and recess 116 are eliminated.

In one example, latch component 42, rear cross component 40, and/or strap 44 are longitudinally centered relative to one another. Coupling member 30 is configured to fold about intermediate section 94 of strap 44 such that each of opposing hooks 102 passes through a corresponding one of latch-receiving apertures 64 hooking on rear surface 56 about an outer edge of latch-receiving apertures 64 to maintain coupling member 30 in the folded position as will be described further below with use of hanger 24. In one embodiment, coupling member 30 is formed as a single piece of injection or otherwise molded material. While coupling member 30 is primarily described with rear cross component 40 including latch-receiving apertures 64 and latch component 42 including opposing hooks 102, in one embodiment (not illustrated), the reverse is true and rear cross component 40 includes opposing hooks 102 and latch component 42 includes latch-receiving apertures 64. Other variations are also contemplated.

Support interface member 32 defines a front surface 130, which is substantially planar, and a second surface 132, which is substantially planar, according to one embodiment. In one example, support interface member 32 is formed as a closed shape, such as a rectangular closed shape, defining a bottom or interference bar 134, a top or support interface bar 136, and opposing sidebars 138 each extending from a different end of interference bar 134 to a corresponding different end of support interface bar 136. In one embodiment, support interface member 32 defines an opening 139 between interference bar 134, support interface bar 136, and opposing sidebars 138. Each of interference bar 134, support interface bar 136, and/or opposing sidebars 138 is substantially linear in one example. Interference bar 134 defines a top longitudinal surface or edge 140 facing support interface bar 136, and support interface bar 136 defines a bottom longitudinal surface or edge 142 facing interference bar 134.

Support interface bar 136 additionally defines a top surface or edge 144 generally facing in a direction opposite bottom edge 142. In one embodiment, support interface bar 136 includes an intermediate or linear portion 146 and two arches 148. Each of the two arches 148 extends outwardly from a different end of linear portion 146. Each arch 148 extends upwardly from linear portion 146, for example, each substantially maintaining an overall height dimension of support interface bar 136. Each arch 148 defines a concavity or cove 150 therebelow that is vertically offset from bottom edge 142, which is, more particularly, defined by linear portion 146, and is open toward interference bar 134. In one example, linear portion 146 of support interface bar 136 additionally defines an indentation 151 including a recessed surface 152 and opposing side edges 154 extending from recessed surface 152 to front surface 130. Recessed surface 152 is, in one embodiment, substantially parallel with each of front surface 130 and second surface 132 and is exposed toward front surface 130. In one example, indentation 151 is longitudinally centered between arches 148. Indentation 151 is at least as wide, as measured from one side edge 154 to the other side edge 154, as a width of strap 44 and, in one instance extends from top edge 144 to lower edge 142 of support interface bar 136, more particularly, linear portion 146 thereof.

In one example, each of opposing sidebars 138 of support interface member 32 defines a front facing groove 160 in the form of an indentation from an outermost side edge of each opposing sidebar 138 adjacent a front corner thereof. Each front facing groove 160 is elongated, for instance, extending along at least about 40% of, and in one example, at least about 50% of, the height of the corresponding opposing sidebar 138. Due to the location of each front facing groove 160, each opposing sidebar 138 forms a coupling flange or rail 162 along a rear side thereof adjacent front facing groove 160. In this manner, a front surface 164 of coupling rail 162 could also be considered a rear wall of front facing groove 160. In one example, coupling rail 162 includes a break or intermediate void 166 near, but spaced upwardly from a bottom of coupling rail 162 and front facing groove 160. Void 166 extends from rear surface 132 through front surface 164.

Support interface member 32 additionally defines a front U-shaped channel 170 and a rear U-shaped channel 172. Front U-shaped channel extends substantially vertically along a majority of a height of each of opposing sidebars 138 and substantially horizontally along nearly all of a width of interference bar 134 to continuously extend from end to end. Front U-shaped channel 170 is open to front surface 130. A rear U-shaped channel 172 is substantially identical to front U-shaped channel 170, but extends from and is open to second surface 132 rather than first surface 130. In this manner, each of front U-shaped channel 170 and rear U-shaped channel 172 reduces the amount of material needed to form hanger 24. In one example, support interface member 32 includes only one or none of front U-shaped channel 170 and rear U-shaped channel 172.

In one example, support interface member 32 includes protrusions or ramps 174 within rear U-shaped channel 172 and extending rearwardly therefrom. Each ramp 174 is positioned near a different opposing top end of rear U-shaped channel in one embodiment. Each ramp 174 is substantially identical and includes an incline surface 176 and a stop surface 178. Inclined surface 176 is also the top surface of the corresponding ramp 174 and tapers from its top edge to a rearmost point of the corresponding ramp 174. Stop surface 178 is also the bottom surface of the corresponding ramp 174 and is substantially horizontal or tapered from its bottom edge to the rearmost point of the corresponding ramp 174. In one embodiment, support interface member 32 is formed as a single piece of injection or otherwise molded material.

Figure 8:
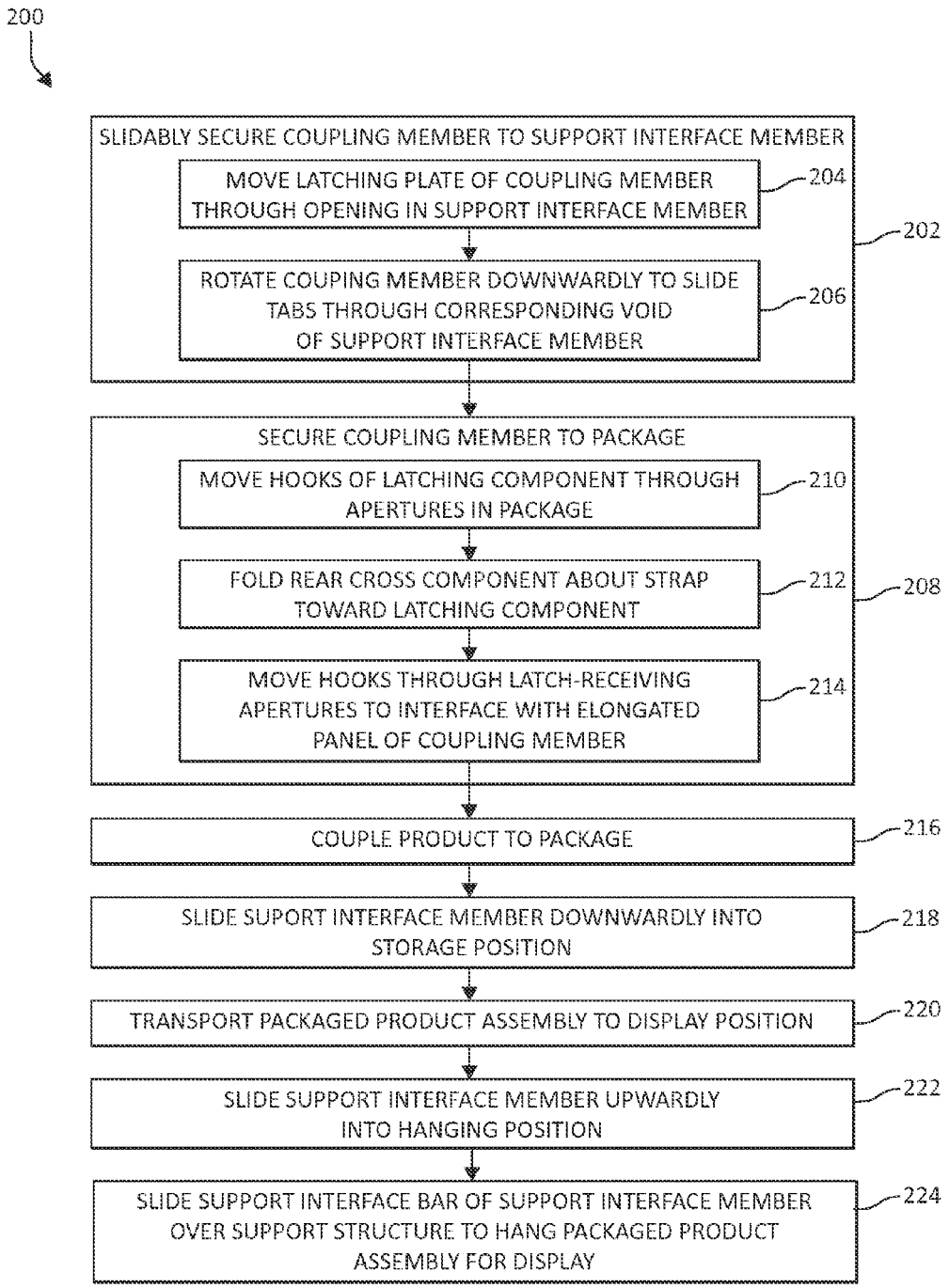
FIG. 8 is a flow chart illustrating a method of forming and displaying one of the packaged product assemblies of FIG. 1, according to one embodiment of the present invention.
Figure 9:
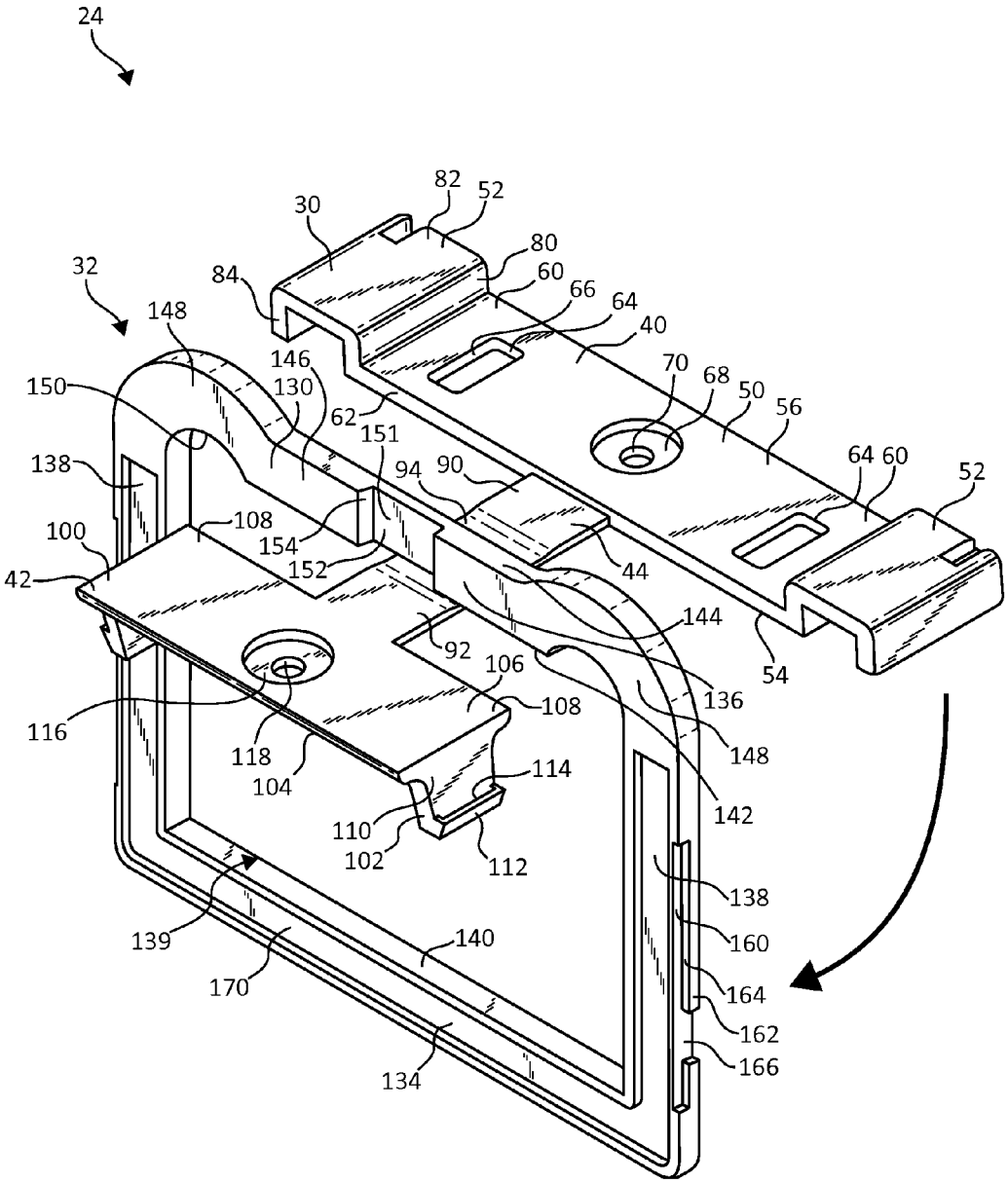
FIG. 9 is a front, perspective view illustration of the hanger of FIG. 2 during assembly, according to one embodiment of the present invention.
Figure 10:
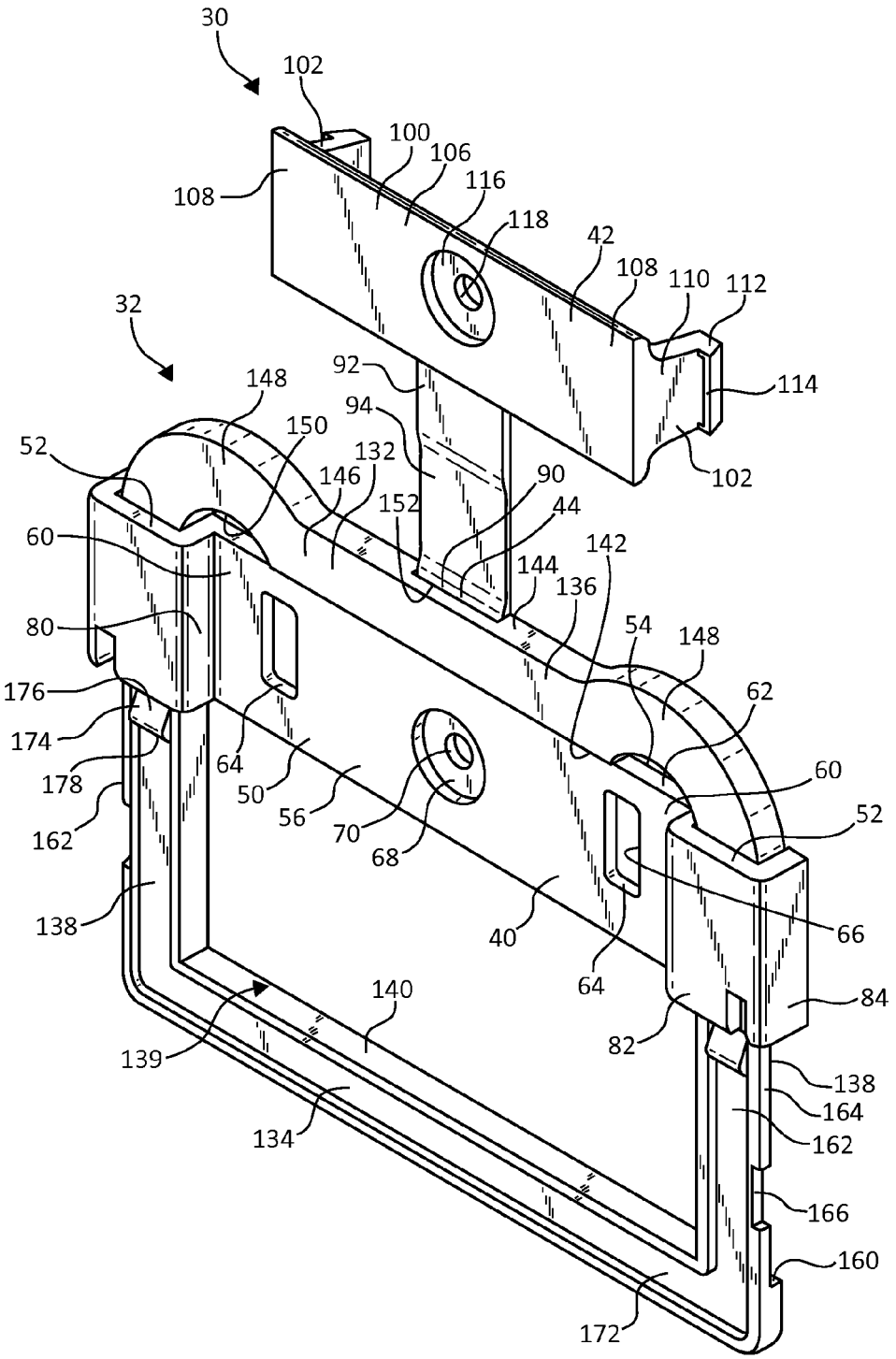
FIG. 10 is a front, perspective view illustration of the hanger of FIG. 2 following assembly, according to one embodiment of the present invention.
Figure 11:
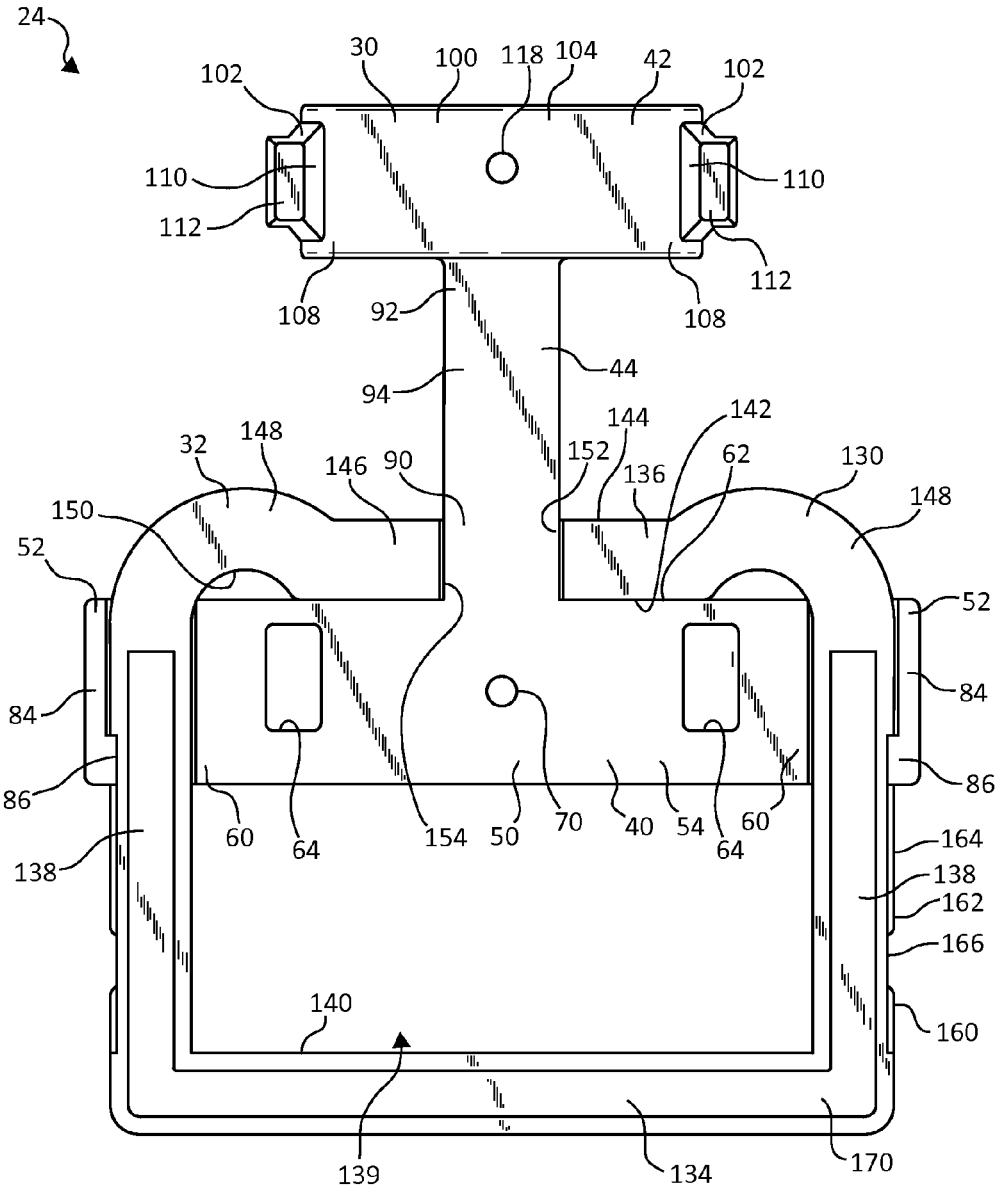
FIG. 11 is a front view illustration of the hanger of FIG. 10, according to one embodiment of the present invention.
Figure 12:
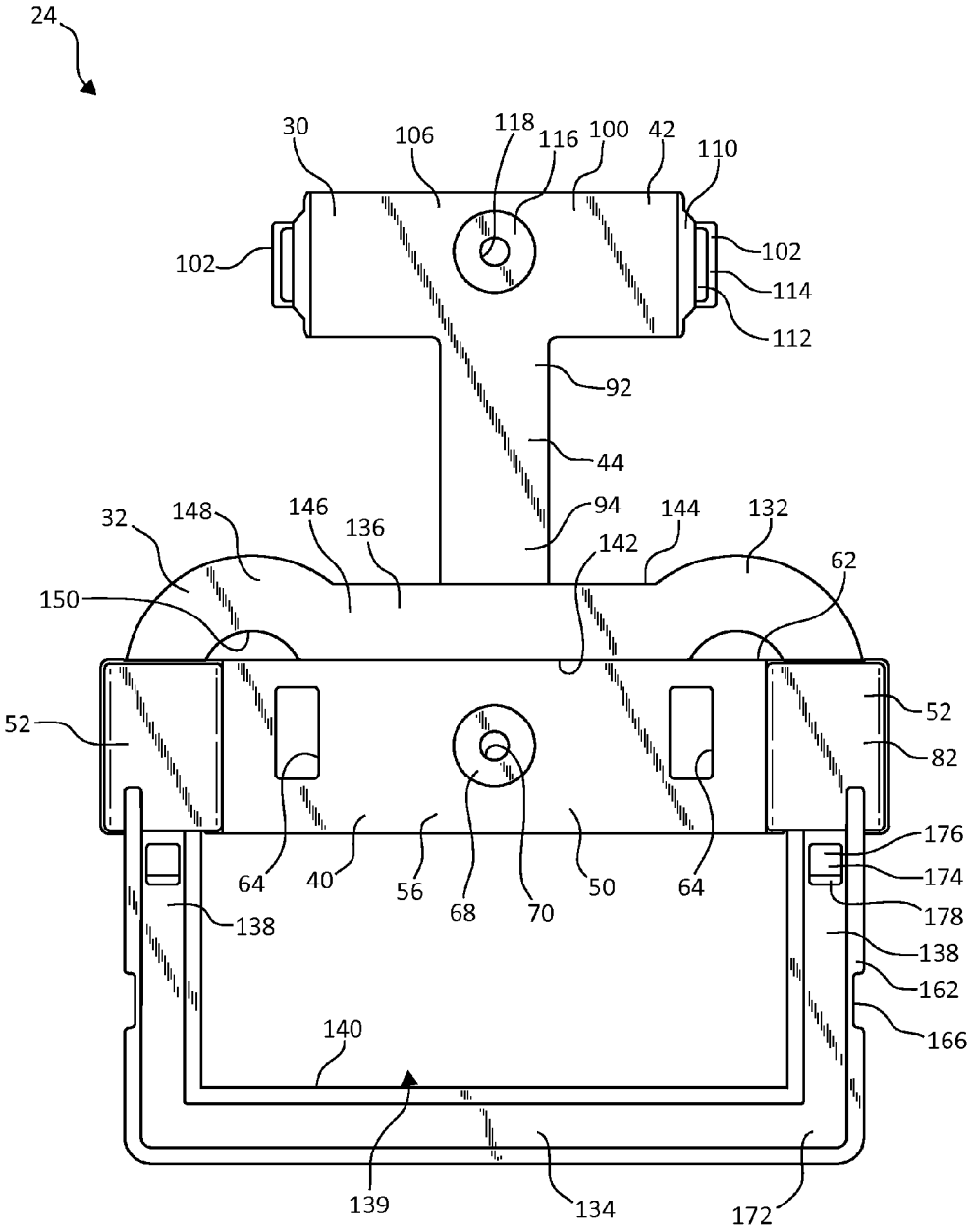
FIG. 12 is a rear view illustration of the hanger of FIG. 10, according to one embodiment of the present invention.
Figure 13:
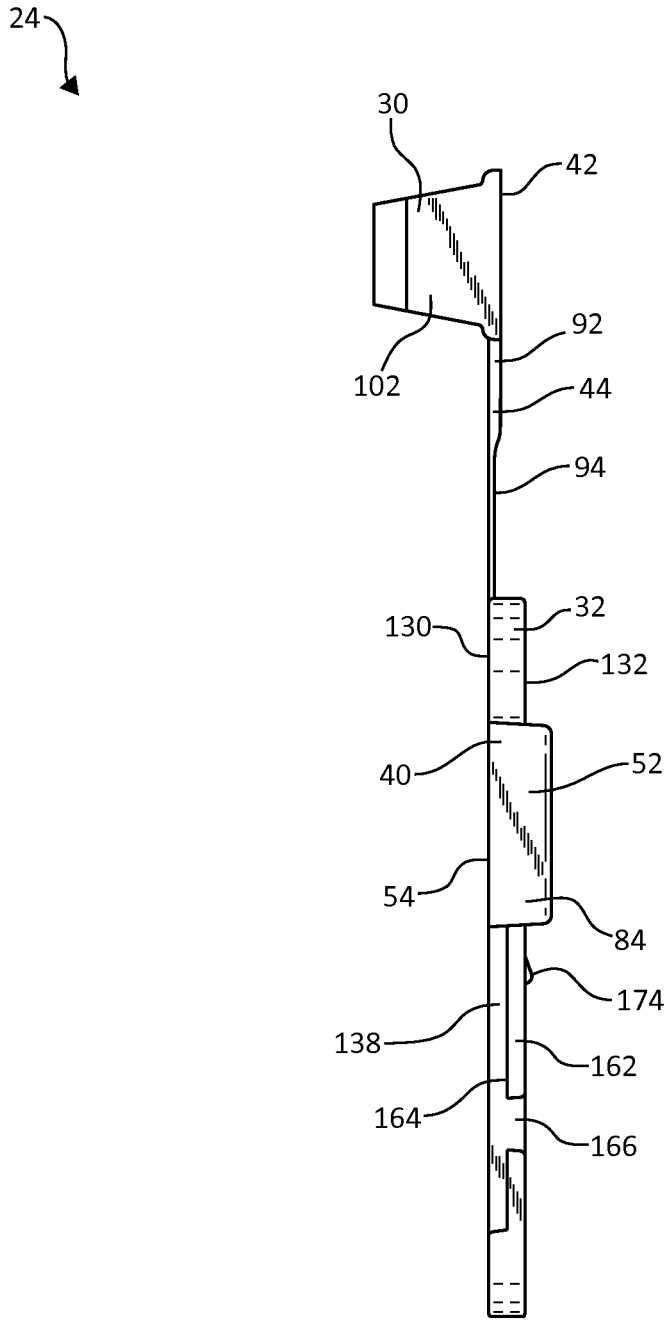
FIG. 13 is a right side view illustration of the hanger of FIG. 10 where the left side view is a mirror image thereof, according to one embodiment of the present invention.
Figure 14:
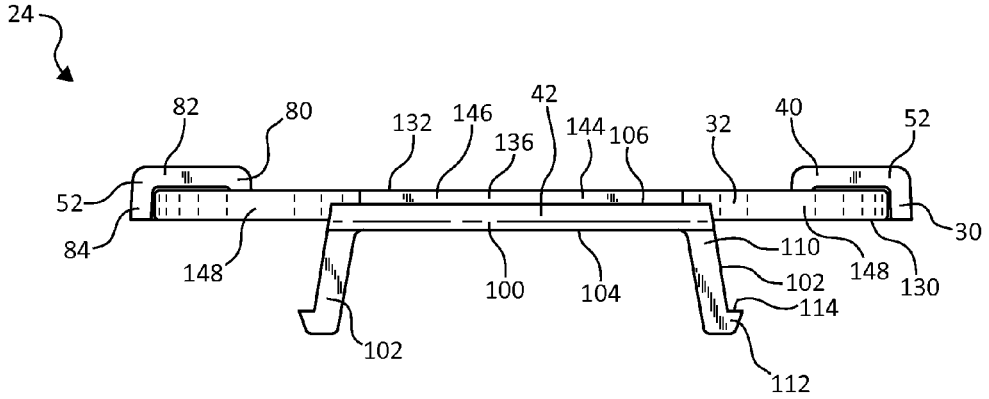
FIG. 14 is a top view illustration of the hanger of FIG. 10, according to one embodiment of the present invention.
Figure 15:
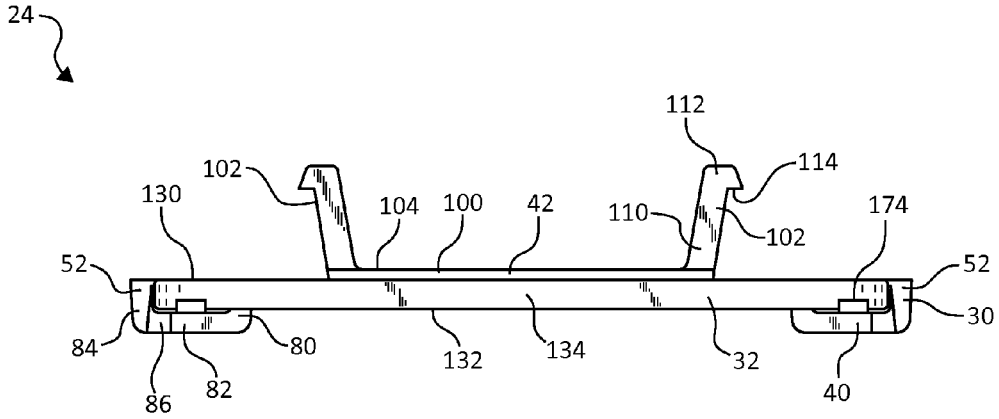
FIG. 15 is a bottom view illustration of the hanger of FIG. 10, according to one embodiment of the present invention.

FIG. 8 illustrates one example of a method 200 of forming and using hanger 24 to display product 20. In one example, hanger 24 is formed at 202 by securing coupling member 30 to support interface member 32 in a manner allowing support interface member 32 to linearly slide relative to coupling member 30, more particularly, relative to rear cross component 40 of coupling member 30. In one example, securing coupling member 30 to support interface member 32 at 201 includes moving latch component 42 of coupling member 30 through opening 139 in support interface member 32 as illustrated in FIG. 9, for instance. In this operation, coupling member 30 placed in a substantially horizontal position with second surface 106 and rear surface 56 of rear cross component 40 facing upwardly. In the horizontal position, latch component 42 of coupling member 30 is moved from a rear side of support interface member 32 through opening 139 as shown in FIG. 9.

Once so positioned, at 206, coupling member 30 rotated clockwise, for example, as indicated by the arrow in FIG. 9, to move rear cross component 40 toward opposing sidebars 138 of support interface member 32. More particularly, to move tabs 86 (see, e.g., FIG. 5) defined by track sections 52 through corresponding voids 166 along sidebars 138 of support interface member 32 and position support interface member 32 such that both front surface 130 and second surface 132 are substantially vertical. When so positioned, each tab 86 of rear cross component 40 is positioned in a different front facing groove 160 of support interface member 32, and each sidebar 138 of support interface member 32 is received within a channel 88 of a corresponding track section 52 in a manner allowing support interface member 32 to linearly slide up and down relative to track sections 52. When support interface member 32 is so slid, tabs 86 move up and down in front facing grooves 160 maintaining coupling member 30 coupled with support interface member 32 via interaction with coupling rail 162. When coupling member 30 is so positioned, in one example, strap 44 of coupling member 30 nests in indentation 151 against recessed surface 152 between side edges 154 as illustrated with additional reference to assembled hanger 24 as illustrated in FIGS. 10-15.

Figure 16:
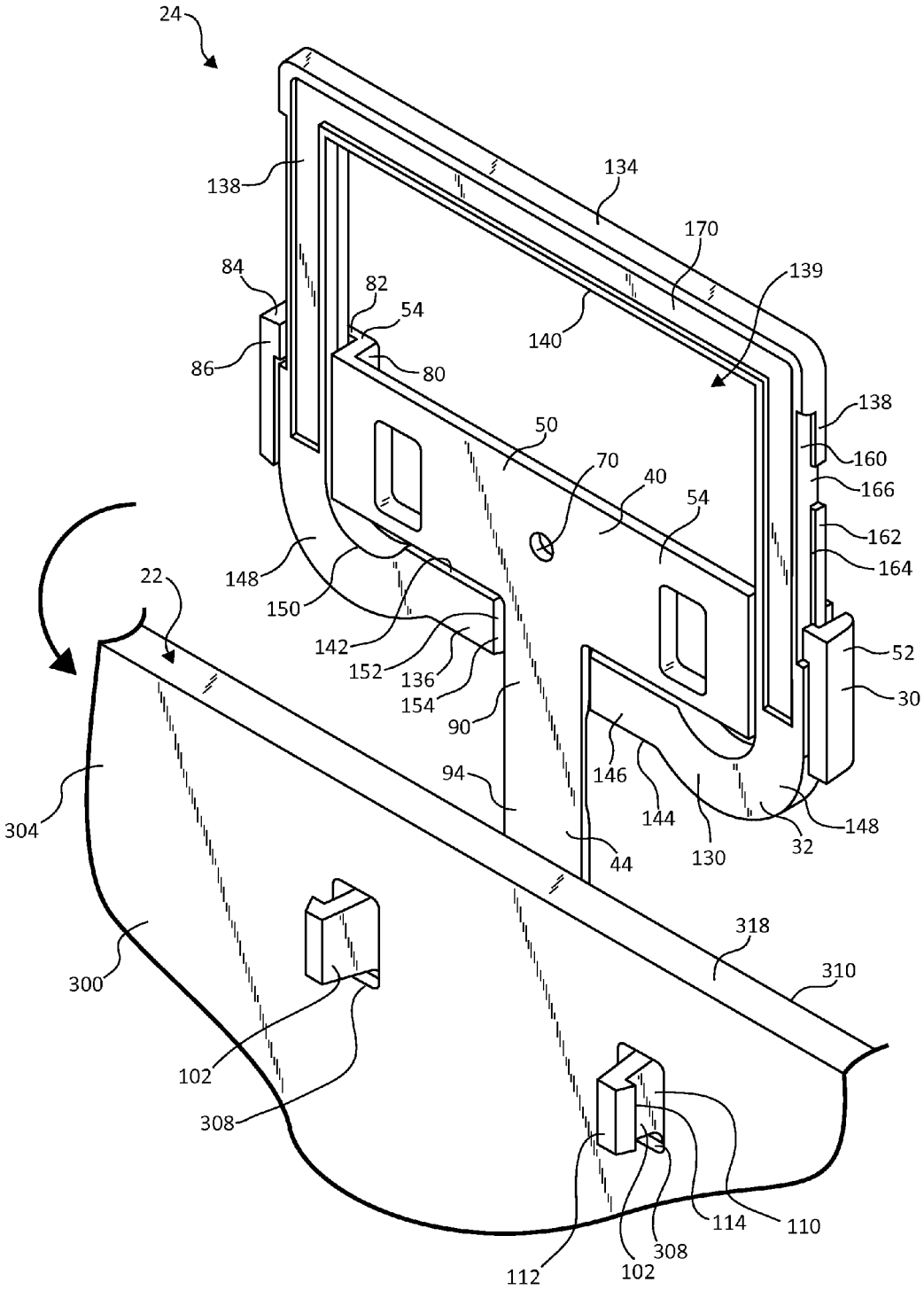
FIG. 16 is a rear, perspective view illustration of the hanger of FIG. 10 positioned for coupling with the package of FIG. 1, according to one embodiment of the present invention.
Figure 17:
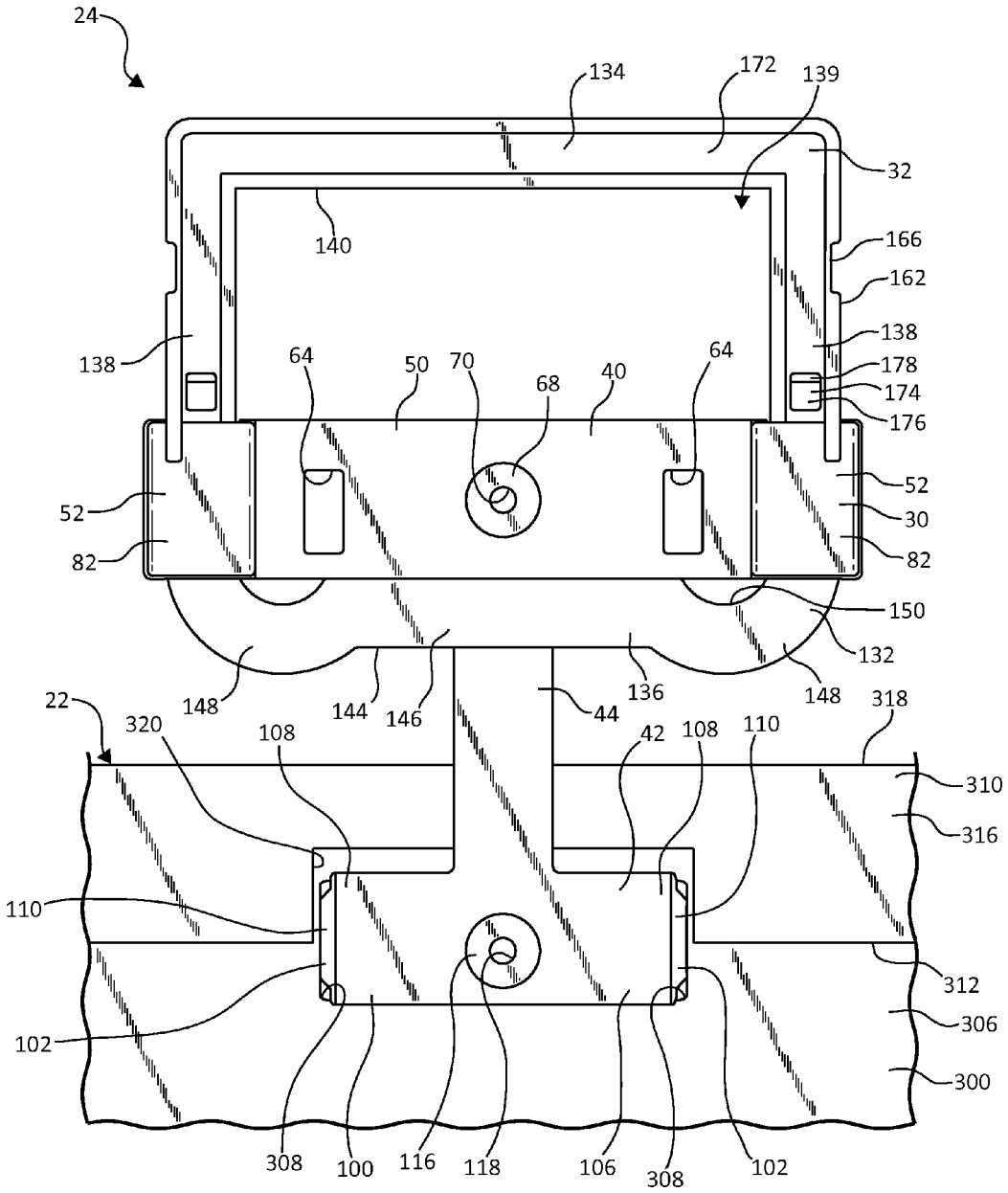
FIG. 17 is a front view illustration of the hanger and package of FIG. 16 during coupling, according to one embodiment of the present invention.

At 210, hanger 24 is coupled with package 22 as illustrated with additional reference to FIGS. 16 and 17. For example, package 22 includes a back panel 300 and securement features 302. Back panel 300 is substantially planar and defines a rear or exterior surface 304 (FIG. 16) and a front or interior surface 306 (FIG. 17) facing opposite exterior surface 304. Backer panel 300 is sized, in one embodiment, to have a length and width substantially identical to or slightly larger than a rear footprint of product 20. Securement features 302 are used to secure product 20 to interior surface 306. In one embodiment, securement features 302 and backer panel 300 are both formed of a single piece of planar material, such as cardboard or paperboard, folded to maintain and protect corners (as illustrated in FIG. 1) or another portion of product 20. In one embodiment, securement features 302 are bands, members, fasteners, etc. formed separately from backer panel 300 to couple product 20 to backer panel 300.

Figure 18:
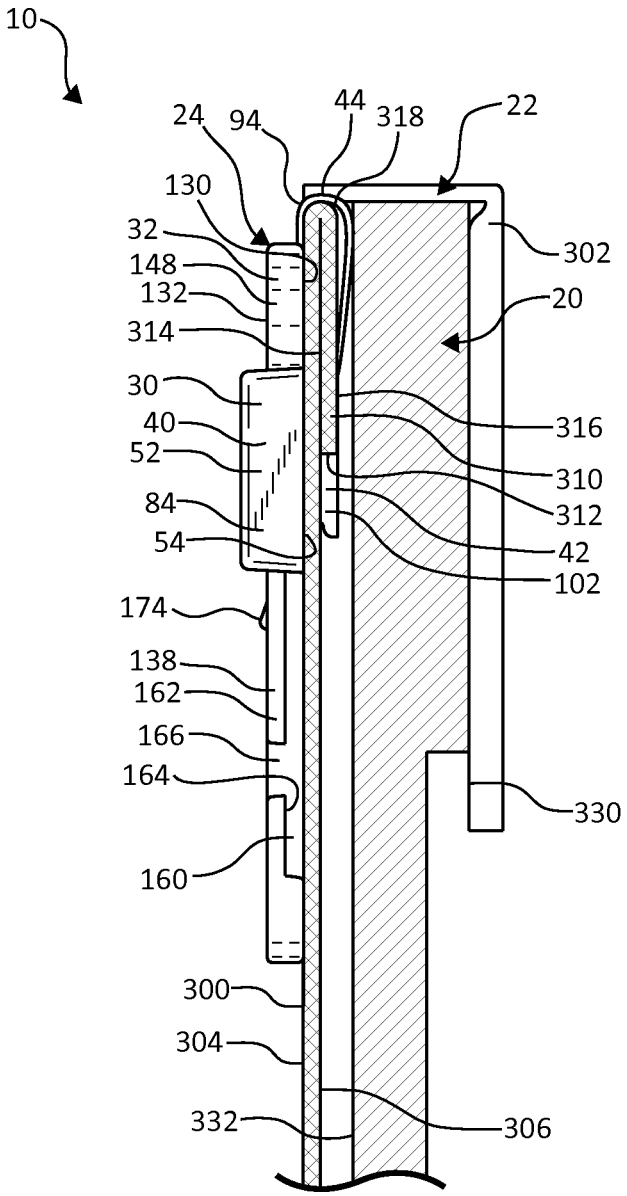
FIG. 18 is a cross-sectional view illustration taken about the line X-X in FIG. 3, according to one embodiment of the present invention.

Package 22 defines holes 308 near a top edge of the package 22. Each hole 308 is sized and shaped and spaced from the other hole 308 to snugly receive one of opposing hooks 102 of latch component 42. In one example, package 22 includes a fold over flap 310 at a top edge thereof as shown in FIGS. 17 and 18 to provide package 22 with a clean folded edge 318 such that free edge 312 of package 22 is positioned inwardly from edges of package 22 to be hidden from view product 20. More specifically, flap 310 is folded such that an interior surface 314 thereof is placed adjacent interior surface 306 of backer panel 300 and an exterior surface thereof faces in the same direction as the interior surface 314 of backer panel 300. In one example, flap 310 also adds overall strength and/or stability to package 22. Flap 310, if any, may include a cutout 320 sized and positioned such that flap 310 will not interfere with securement of coupling member 30 to package 22. In one embodiment, flap 310 includes apertures (not shown) aligning with apertures 308 in backer panel 300 configured to receive opposing hooks 102 rather than cutout 320.

At 210, opposing hooks 102 of latch component 42 of coupling member 30 are moved from a rear side of backer panel 300 through apertures 308. Hooks 102 are biased outwardly, but are configured to flex inwardly slightly to allow opposing hooks 102 to move through apertures 308. When each hook 102 is positioned through one of apertures 308, its bias pushes the corresponding hook 102 outwardly in a manner securing backer panel 300 between free edge 114 of each hook 102 and exterior surface 304 of backer panel 300 as illustrated in FIGS. 16 and 17.

At 212, rear cross component 40 is folded rearwardly about intermediate section 94 of strap 44 over latch component 42 to align latch-receiving apertures 64 of rear cross component 40 with opposing hooks 102 and to wrap strap 44 around top edge 318 of backer panel 300. In one embodiment, a length of strap 44 facilitates coupling of hanger 24 to backer panel 300, more particularly, strap 44 serves to prevent placement of hanger 24 too low on backer panel 300 by interacting with top edge 318 of backer panel 300. Hanger 24 would be considered too low on backer panel 300 if, even when support interface member 32 is in the hanging position, support interface bar 136 of support interface member 32 does not extend far enough over top edge 318 of backer panel 300 to allow support structure 16 (FIG. 1) to pass through opening 139. Strap 44 also facilitates assembly by providing both rear cross component 40 and latch component 42 as a single item for assembly rather than two separate items.

Rear cross component 40 is moved toward elongated pate 100 such that hooks 102 once again flex inwardly to pass through latch-receiving apertures 64 of rear cross component 40 and flex outwardly once through latch-receiving apertures 64 at 214. In this manner, free edges 114 of hooks 102 interface with rear surface 56 of rear cross component 40 adjacent outer edges of latch-receiving apertures 64 to secure rear cross component 40 to latch component 42 with backer panel 300 interposed therebetween. In one example, hooks 102, more particularly, offset wall 110, is sized such that rear cross component 40 is maintained abutting backer panel 300 and backer panel 300 is maintained abutting elongated plate 100 of latch component 42 as shown for example, in the cross sectional view of FIG. 18 and FIGS. 2 and 3. In this manner, hanger 24 is fully secured to package 22, in one embodiment, without the use of any additional fasteners or fastening agents, etc. to coupling member 30 and support interface member 32. In one example, strap 44 extends over folded edge 318 as it extends between rear cross component 40 and latch component 42. In one example, such as where product 20 has a heavy weight, an additional fastener (not shown) may be inserted through apertures 70 and 118 of rear cross component 40 and latch component 42 to further secure latch component 42 to rear cross component 40.

When hanger 24 is secured to package 22, a portion of each opposing sidebar 138 of support interface member 32 is maintained between the corresponding track section 52 of rear cross component 40 and exterior surface 304 of backer panel 300. Support interface member 32 is thereby able to slide up and down relative to coupling member 30 between the storage position of FIG. 3 and the use position of FIGS. 1 and 2.

At 216, product 20 is coupled to package 22. Product 20 is any suitable member, for example, a frame, artwork, wall hanging, etc., having a front surface 330 and a rear surface 332 opposite front surface 332. Front surface 330 is the surface that will be visually presented to potential consumers or other viewers during hanging, in one example. Rear surface 332 faces backer panel 300, and is secured to package 22, for example, with securement features 302, such that rear surface 332 abuts exterior surfaces 316 of one or more flaps 310 and elongated plate 100 of latch component 42 is interposed between backer panel 300 of package 22 and rear surface 332 of product 20 as shown in FIGS. 1 and 18. As such, packaged product assembly 10 is formed.

Hanger 24, more particularly, support interface member 32 is moved to the storage position in 218 by linearly sliding support interface member 32 relative to rear cross component 40 of coupling member 30. In one embodiment, interaction between interference bar 134 and top edge 62 of rear cross component 40 of coupling member 30 limits downward movement of support interface member relative to coupling member 30. In the storage position, in one embodiment, support interface member 32 is entirely positioned below folded top edge 318, that is, within the overall footprint of package 22 and/or of backer panel 300. At 220, packaged product assembly 10 is transported to its desired display location. At 222, support interface member 32 is slid linearly upwardly into the hanging position, in which at least support interface bar 136 thereof extends above folded top edge 318 beyond the footprint of backer panel 300. In one example, sliding support interface member 32 into the hanging position moves ramps 174 upwardly past top edges of track sections 52 by slightly pushing rear walls 82 of track sections 52 rearwardly via movement of inclined surfaces 176 of ramps 174 on rear walls 82. Sliding support interface member 32 into the hanging position moves ramps 174 above track sections 52 such that stop surfaces 178 of ramps 174 rest on top edge of rear walls 82 when support interface member 32 is released. The interaction between ramps 174 and the top edge of rear walls 82 facilitate maintaining hanger 24 in the hanging position even prior to hanging support interface member 32 on support structure 16 or other supporting member.

In one example, ramps 174 are sufficiently small in size to allow support interface member 32 to be moved back to the storage position by application of sufficient downward force to support interface member 32 to cause rear walls 82 of track sections 52 of rear cross component 40 to flex rearwardly and allow ramps 174 to slide downwardly just in front of rear walls 82. In this manner, ramps 174 prevent or decrease the occurrences in which support interface member 32 would inadvertently slide down to a storage positioned while packaged product assembly 10 is being hung, thereby, increasing the usability of the hanger 24.

At 224, a support structure 16 is slid through opening 139 of support interface member 32 above folded top edge 318 of package 22 to interface with lower edge 142 of support interface bar 136 such that packaged product assembly 10 is hung from support structure 16. In one example each of the two parallel rods 18 of support structure 16 is positioned within a different one of coves 150 defined by support interface bar 136 to provide rotationally stable hanging of packaged product assembly 10. Following use, hanger 24 optionally can be transitioned, that is slid, back to the storage position.

Although the invention has been described with respect to particular embodiments, such embodiments are for illustrative purposes only and should not be considered to limit the invention. Various alternatives and other modifications within the scope of the invention in its various embodiments will be apparent to those of ordinary skill.

What is claimed is:

1. A merchandise hanger comprising:

a coupling member including:

a cross component including an elongated panel and a track section, wherein the elongated panel defines latch-receiving apertures extending through the elongated panel, a latch component including an elongated plate and opposing hooks extending rearwardly from the elongated plate, and a flexible strap extending from the cross component to the latch component to couple the cross component to the latch component, wherein the coupling member is configured to be folded about the flexible strap to move the opposing hooks of the latch component into alignment with the latch-receiving apertures of the cross component, and the opposing hooks are configured to move through the latch-receiving apertures to couple the cross component to the latch component; and a support interface member slidably received within the track section of the coupling member, the support interface member being configured to hang from a support structure in a hanging position and being configured to slidably transition between a storage position and the hanging position.

2. The merchandise hanger of claim 1, wherein the flexible strap is substantially linear and elongated.

3. The merchandise hanger of claim 1, wherein:

the track section is a first track section, the coupling member includes a second track section, each of the first track section and the second track section defines a front-facing channel, and the support interface member includes two opposing sidebars each slidably maintained in the front-facing channel of a different one of the first track section and the second track section.

4. The merchandise hanger of claim 3, wherein:

the coupling member includes a tab extending partially across a rear opening of the first track member, the support interface member defines an elongated groove along a front side thereof, and the tab is slidably received within the elongated groove to maintain one of the opposing sidebars within a corresponding one of the front-facing channels.

5. The merchandise hanger of claim 3, wherein the support interface member defines a protruding ramp extending rearwardly from one of the opposing sidebars, and the protruding ramp selectively maintains the support interface member in the hanging position via interaction with a top edge of the coupling member.

6. The merchandise hanger of claim 3, wherein the support interface member includes a support interface bar extending between the two opposing sidebars and being configured to be placed on top of the support structure to hang the merchandise hanger from the support structure.

7. The merchandise hanger of claim 6, wherein the support interface bar defines an indentation sized and shaped to selectively receive a portion of the flexible strap of the coupling member.

8. The merchandise hanger of claim 1, wherein the coupling member is formed as a single piece.

9. The merchandise hanger of claim 8, wherein the single piece is an injection-molded piece.

10. The merchandise hanger of claim 1, wherein the support interface member is formed as a single piece.

11. The merchandise hanger of claim 1, in combination with a product package, wherein:

the product package includes a backer panel, the opposing hooks extend from the elongated plate through the backer panel and through the cross component to couple the merchandise hanger to the product package.

12. The merchandise hanger of claim 1, wherein:

the cross component is located on a first side of the backer panel, the latch component is located on a second side of the backer panel opposite the first side of the backer panel, and the flexible strap extends around an edge of the backer panel.

13. A support hanger comprising:

a first member including:

an elongated cross panel configured to be secured to a package, a first track section on one end of the elongated cross panel, and a second track section on an opposing end of the elongated cross panel, wherein each of the first track section and the second track section defines a U-shaped channel and a securement tab extending partially across an opening to the U-shaped channel;

a second member slidably coupled with the first member, the second member including:

a support interface bar, and opposing sidebars depending from opposing ends of the support interface bar, wherein each opposing sidebar defines a longitudinal corner edge with a longitudinal groove therein, the securement tab being slidably positioned within the longitudinal groove to maintain each of the opposing sidebars within a different corresponding one of the first track section and the second track section during sliding of the second member relative to the first member between a hanging position and a storage position.

14. The support hanger of claim 13, wherein:

the second member includes an interference bar extending between the opposing sidebars to form the second member in a closed configuration, and the interference bar interacts with the first member to maintain the second member coupled to the first member in the hanging position.

15. The support hanger of claim 13, wherein the opposing sidebars include an opening therethrough to allow the securement tab to move from a rear side of the opposing sidebars and into the longitudinal groove on a front side of the opposing sidebars.

16. The support hanger of claim 13, wherein the first member includes:

a latch component including an elongated plate and a hook extending rearwardly from opposite ends of the elongated plate, and an elongated strap extending between and coupling the latch component to the elongated cross panel.

17. The support hanger of claim 16, wherein:

the elongated cross panel defines a latch-receiving aperture, the elongated strap is flexible and folds to align the latch component with the elongated cross panel, and the hook extends through the latch-receiving aperture to couple the elongated cross panel to the latch component and form the elongated strap as a loop between the elongated cross panel and the latch component.

18. The support hanger of claim 17, in combination with a package backer panel, the backer panel being secured between the elongated cross panel and the latch component, the hook extending through the package backer panel, and the strap extending over an outer edge of the package backer panel.

19. The support hanger of claim 18, wherein the support interface bar only extends beyond the outer edge of the package backer panel when the second member is in the hanging position and not when the second member is in the storage position.

20. A method of securing a hanger to a packaged product, the method comprising:

providing a coupling member including:

a cross component having two track sections each forming an open channel, a latch component having two hooks, and a strap extending between the cross component and the latch component;

providing a support interface member including:

a support interface bar, and two opposing sidebars extending downwardly from opposite ends of the support interface bar;

slidably securing each of the two opposing sidebars within the open channel of a different one of the two track sections;

placing each of the two hooks through a package panel of the packaged product;

folding the strap to align the cross component with the latch component and securing each of the two hooks through the latch component such that the package panel is maintained between the cross component and the latch component and such that the strap extends over an outer edge of the package panel, wherein:

the package panel of the packaged product is secured between the cross component and the latch component with the strap extending around an edge of the package panel of the packaged product, and the support interface bar is configured to slide between a first position within a footprint of package panel and a second position extending beyond the edge of the package panel.

* * * * *